US006750759B2

(12) United States Patent
Kojima

(10) Patent No.: US 6,750,759 B2
(45) Date of Patent: Jun. 15, 2004

(54) ANNUNCIATORY SIGNAL GENERATING METHOD AND DEVICE FOR GENERATING THE ANNUNCIATORY SIGNAL

(75) Inventor: Hiroshi Kojima, Tokyo (JP)

(73) Assignee: NEC Infrontia Corporation, Kawasaki (JP)

( * ) Notice: Subject to any disclaimer, the term of this patent is extended or adjusted under 35 U.S.C. 154(b) by 302 days.

(21) Appl. No.: 09/729,247

(22) Filed: Dec. 5, 2000

(65) Prior Publication Data

US 2001/0017586 A1 Aug. 30, 2001

(30) Foreign Application Priority Data

Dec. 7, 1999 (JP) ..... 11-348105

(51) Int. Cl.[7] ..... G08B 3/10

(52) U.S. Cl. ..... 340/384.5; 340/384.3; 340/384.4; 340/384.7; 381/119; 704/225; 704/226

(58) Field of Search ..... 340/384.5, 384.7, 340/384.71, 384.3, 384.4, 691.1, 691.2, 692, 691.8; 381/119, 104, 107, 109, 101, 102; 704/224, 225, 226, 227, 228; 369/3

(56) References Cited

U.S. PATENT DOCUMENTS 3,838,217 A * 9/1974 Dreyfus ..... 704/225
4,020,286 A * 4/1977 Ceci ..... 704/226
4,189,718 A * 2/1980 Carson et al. ..... 340/384.4
4,206,448 A * 6/1980 Davis ..... 340/384.4
4,672,590 A * 6/1987 Tendler ..... 367/116
4,792,789 A * 12/1988 Matsumuro ..... 340/384.7
5,086,471 A * 2/1992 Tanaka et al. ..... 704/222
5,544,250 A * 8/1996 Urbanski ..... 381/94.3
5,708,722 A * 1/1998 Forgues et al. ..... 381/94.1
6,122,610 A * 9/2000 Isabelle ..... 704/226

FOREIGN PATENT DOCUMENTS

| | | |
|---|---|---|
| JP | 60-163097 | 8/1985 |
| JP | 5-108979 | 4/1993 |
| JP | 5-181463 | 7/1993 |
| JP | 7-28485 | 1/1995 |
| JP | 11-73256 | 3/1999 |

OTHER PUBLICATIONS

Japanese Office Action dated Aug. 19, 2003 with English translation of pertinent portions.

* cited by examiner

*Primary Examiner*—Daniel J. Wu
*Assistant Examiner*—Son Tang
(74) *Attorney, Agent, or Firm*—Whitham, Curtis & Christofferson P.C.

(57) ABSTRACT

When a dividing ratio data is written in a counter/timer register 530, a counter/timer circuit 534 divides a frequency of an oscillation signal of the oscillator 532 as much as the dividing ratio data. When an output enabling data is written in the port B register 536, a variable gain control signal is output from an envelope producing circuit 538. A variable gain control circuit 540 changes amplitude of a dividing signal as much as the value responsive to a voltage of the variable gain control signal. When an output disabling data is written in the port B register 536, the variable gain control signal is not output from the envelope producing circuit 538. The variable gain control circuit 540 stops the amplitude control of the dividing signal.

13 Claims, 6 Drawing Sheets

ANNUNCIATORY SIGNAL GENERATING METHOD AND DEVICE FOR GENERATING THE ANNUNCIATORY SIGNAL

BACKGROUND OF THE INVENTION

The present invention relates to an annunciatory signal generating method and a device for generating the annunciatory signal, and more practically to an annunciatory signal generating method and a device for generating the annunciatory signal capable of avoiding the annunciatory signal from being superimposed by a grating noise thereon.

FIG. 1 shows a motherboard (PC/AT compatible motherboard) 200 and a soundboard 300 connected thereto composing a personal computer. The motherboard 200 is connected to the soundboard 300 by a connecting cable 200 through an expansion slot 202 of the motherboard 200 and a slot 302 of the soundboard 300.

The motherboard 200 provides a buzzer circuit 204 and the soundboard 300 provides a sound circuit 304 therein. Both of the buzzer circuit 204 and the sound circuit 304 are composed to produce a buzzer signal or other kinds of acoustical signals (musical sounds, PCM reproduced sound) under controls of a CPU 206 accommodated on the motherboard 200. The soundboard 300 is connected to the motherboard 200 through the expansion slot 202 in order to produce the above-mentioned other acoustical signals under controls of the CPU 206. Incidentally, the buzzer signal is composed to be supplied from the motherboard 200 to the soundboard 300 and to turn to be a sound output through a common output system sharing the use with other acoustical signals in the soundboard 300.

The buzzer circuit 204 comprises a counter/timer register 212 in which a data (a dividing ratio data) specified by a buzzer frequency is set by order from the CPU 206 through buses 208 and 210, a oscillator 214, a counter/timer circuit 216 for outputting a buzzer rectangular wave signal of a desirable buzzer frequency obtained by dividing an oscillation frequency of the oscillator 214 as much as the value determined by the dividing ratio data set in the counter/timer register 212, a port B register 218 in which an output enabling data or an output disabling data of the buzzer signal are set by order from the CPU 206 through the buses 208 and 210, an AND circuit 220 connected to outputs of the counter/timer circuit 216 and the port B register 218 and an amplification circuit 222 in which an output thereof is connected to a buzzer output terminal 224 of the motherboard 200. Incidentally, 226 indicates a circuit for a PC/AT compatible, which is formed on a LSI 228 for PC/AT compatible together with the counter/timer register 212, the counter/timer circuit 216, the port B register 218 and the AND circuit 220. Further, the LSI 228 for PC/AT compatible is accommodated on the PC/AT compatible motherboard 200 together with the CPU 206 and the oscillator 214.

The buzzer output terminal 224 of the motherboard 200 is connected to a buzzer input terminal 304 of the soundboard 300.

A sound circuit 304 of the soundboard 300 comprises; an electronic volume 306 connected to the buzzer input terminal 304, a sound control register 30 in which a first data for specifying a kind, scale and volume of the musical sound or a second data for specifying a PCM sound is set by order from the CPU 206 through the bus 208, the connecting cable 250 and a bus 307, a musical sound producing circuit 310 and an electronic volume 312 controlled by the first data set in the sound control register 308, a PCM reproducing circuit 314 and an electronic volume 316 controlled by the second data set in the sound control register 308, a mixer 318 connected to outputs of the volumes 306, 312 and 316 and an oscillation circuit 322 connected to an output of the mixer 318. An output of the oscillation circuit 322 is connected to the sound output terminal 324. Incidentally, the electronic volume 306, the sound control register 308, the musical sound producing circuit 310, the electronic volume 312, the PCM reproducing circuit 314, the electronic volume 316 and the mixer 318 are formed on a sound LSI 324.

And when the dividing ratio data is set in the counter/timer register 212 by order from the CPU 206, the buzzer rectangular wave signal of the frequency obtained by dividing an oscillation signal (FIG. 2 (1)) of the oscillator 214 as much as the value determined by the dividing ratio data is output from the counter/timer circuit 216 and supplied to an input on one side the AND circuit 220 in the buzzer circuit 204.

And when an output enabling data (FIG. 2 (2)) of the buzzer signal is set in the port B register 218 by order from the CPU 206 through the buses 208 and 210, a binary signal "1" (a high level signal) is output from the port B register 218 and supplied to an input on another side of the AND circuit 220.

Then the buzzer signal is supplied from the AND circuit 220 to the amplification circuit 222 and output from the buzzer output terminal 224. After transferred to the electronic volume control 306 of the soundboard 300 through a connecting line 252, the above-mentioned buzzer signal is further transferred through the mixer 318 and the amplification circuit 320, and finally output as a buzzer signal from the sound output terminal 322.

When the output disabling data is written in the port B register 218, the buzzer signal is not output.

And when a data for specifying a desirable kind, scale and volume of a musical sound is set in the sound control register 308 by order from the CPU 206, a signal of the musical sound responsive to the above-mentioned data is transferred through the musical sound producing circuit 310, the electronic volume 312, the mixer and the amplification circuit 320 and output as a signal of the musical sound from the sound output terminal 324. And when a data for specifying a signal of desirable PCM waveform to be reproduced is set in the sound control register 308 by order from the CPU 206, a signal of the PCM waveform responsive to the above-mentioned data is transferred through the PCM reproducing circuit 314, the electronic volume 316, the mixer 318 and the oscillation circuit 320 and output as a signal of the desirable PCM waveform to be reproduced from the sound output terminal 324.

Incidentally, the above-mentioned buzzer circuit 204 has a system in which output of the buzzer signal is controlled by binary signals output from the port B register 218 and accordingly the buzzer signal causes a rapid transition at the beginning and the end.

Therefore, when a buzzer signal output from the sound circuit 304 is supplied to a buzzer, an amplitude of a beeping sound emitted from the buzzer indicates 0 or a certain amplitude value as shown in FIG. 2 (3). Accordingly, this causes trouble in that grating sounds are suddenly emitted from the buzzer at the beginning and the end of the buzzer sound.

Further, in order to output a buzzer signal produced in the motherboard 200 as a sound signal through the common output system of the sound signal of the soundboard 300, the soundboard 300 needs to be connected to the motherboard

200 by the connecting cable 252 and requires a troublesome work for installing in a personal computer.

SUMMARY OF THE INVENTION

It is therefore an object of the present invention to provide an annunciatory signal generating method and a device for generating the annunciatory signal without having a grating noise, in view of the above-mentioned circumstances.

Other objects of the present invention will become clear as the description proceeds.

In order to solve the above-mentioned problem, the invention according to a first aspect of the invention relates to an annunciatory signal generating method for generating an annunciatory signal based on a signal used for generating the annunciatory signal, a first signal for indicating a start of the annunciatory signal and a second signal for indicating a stop of the above-mentioned annunciatory signal, in which a variable gain control signal which boots up gently and makes a transition at a predetermined level of fluctuation based on the above-mentioned first signal and boots down gently based on the above-mentioned second signal and sequentially the above-mentioned annunciatory signal is generated by controlling the amplitude of the above-mentioned signal for generating the annunciatory signal under the above-mentioned variable gain control signal.

The invention also relates to the annunciatory signal generating methods, as described above, in which the above-mentioned second signal is generated from the above-mentioned first signal.

The invention further relates to the annunciatory signal generating methods, as described above, in which the above-mentioned first and second signals are "1" and "2" of a binary signal respectively.

The invention as described above further relates to annunciatory signal generating methods, in which the above-mentioned first and second signals are obtained by decoding a data for indicating the types of the annunciatory signal.

According to a second aspect of the invention, there is provided first means for outputting a signal used for generating the annunciatory signal and second means for outputting a first signal for indicating a start of the annunciatory signal and a second signal for indicating a stop of the annunciatory signal. The invention according to this aspect relates to an annunciatory signal generating device for generating the annunciatory signal based on a signal used for generating the annunciatory signal output from the above-mentioned first means and also based on the above-mentioned first signal and the above-mentioned second signal output from the above-mentioned second means. Further, in the invention according to this aspect, there is provided means for generating a variable gain control signal which is connected to the above-mentioned second means, by which a variable gain control signal boots up gently and makes a transition at a predetermined level of fluctuation based on the above-mentioned first signal output from the above-mentioned second means and boots down gently based on the above-mentioned second signal output from the above-mentioned second means and means for controlling variable gain which is connected to the above-mentioned first means and to the above-mentioned means for generating variable gain control signal and outputs the above-mentioned annunciatory signal by controlling the amplitude of the signal used for generating the above-mentioned annunciatory signal output from the above-mentioned first means by the above-mentioned variable gain control signal generated from the above-mentioned means for generating variable gain control signal are provided.

The invention as described above also relates to the annunciatory signal generating device in which the above-mentioned second means is to generate the above-mentioned second signal from the above-mentioned first signal.

The invention according to the second aspect also relates to the annunciatory signal generating device, in which the above-mentioned first means comprises an oscillator, means for outputting dividing ratio signal for outputting a dividing ratio signal and a dividing circuit for dividing a frequency of an oscillation signal output from the above-mentioned oscillator as much as the dividing ratio of the dividing ratio signal output from the above-mentioned means for outputting dividing ratio signal.

The invention further relates to the annunciatory signal generating device in which the above-mentioned second means outputs the above-mentioned first signal as "1" and the above-mentioned second signal as "0" of the binary signal respectively and the above-mentioned means for generating variable gain control signal is composed of the transfer function capable of outputting a signal portion which is responsive to "1" of the above-mentioned binary signal, boots up gently and makes a transition at a predetermined level of fluctuation in the above-mentioned variable gain control signal and at the same time, capable of outputting a signal portion which is responsive to "0" of the above-mentioned binary signal and boots down gently in the above-mentioned variable gain control signal.

Further according to the second aspect of the invention, there is provided annunciatory signal generating device in which the above-mentioned second means outputs the above-mentioned first signal as "1" and the above-mentioned second signal as "0" of the binary signal respectively. And the above-mentioned means for generating variable gain control signal of the above-mentioned invention comprises; decoding means for outputting a start-reading address in response to "1" of the above-mentioned binary signal and a stop-reading address in response to "0" of the binary signal, means for outputting addresses for outputting the above-mentioned start-reading address, updating an address from the above-mentioned start-reading address and determining whether the updated address reached to the above-mentioned stop-reading address or not and memories for storing variable gain control data capable of providing the similar effects as the above-mentioned variable gain control signal. Further, the above-mentioned means for generating variable gain control signal reads the above-mentioned memory by the address from a start-reading address to a stop-reading address output from the above-mentioned means for outputting address and supplies the variable gain control data to the above-mentioned means for controlling variable gain by each address.

Further, the annunciatory signal generating device according to the second aspect of the invention, the above-mentioned second means outputs the above-mentioned first signal and the above-mentioned second signal as a signal for indicating the type of the above-mentioned annunciatory signal. And the above-mentioned means for generating variable gain control signal of the above-mentioned invention comprises; decoding means for decoding the signal indicating the type of the above-mentioned annunciatory signal and outputting the start-reading address and the stop-reading address, means for outputting addresses for outputting the above-mentioned start-reading address, updating an address from the above-mentioned start-reading address and determining whether the updated address reached to the above-mentioned stop-reading address or not and memories for storing variable gain control data capable of providing the similar effects as the above-mentioned variable gain control signal in response to the start-reading address and the stop-reading address output from the above-mentioned decoding means. Further, the above-mentioned means for generating variable gain control signal in the above-mentioned memory by the address from a start-reading address to a stop-reading address output from the above-mentioned means for outputting address and supplies the variable gain control data to the above-mentioned means for controlling variable gain by each address.

The invention according to the second aspect also relates to an annunciatory signal generating device, in which the above-mentioned means for generating variable gain control signal is composed to operate at predetermined intervals after operating on receiving a signal from the above-mentioned second means.

The invention according to the second aspect further relates to an annunciatory signal generating device in which the above-mentioned second means is a central processing unit accommodated in a motherboard and the above-mentioned means for generating variable gain control signal is accommodated in a soundboard connected to the above-mentioned motherboard.

The invention according to the second aspect further relates to an annunciatory signal generating device in which the above-mentioned means for generating variable gain control signal accommodated in the above-mentioned soundboard has a composition capable of maintaining the compatibility of application programs in the central processing unit accommodated in the above-mentioned motherboard.

DETAILED DESCRIPTION OF THE PREFERRED EMBODIMENTS

Figure 1:
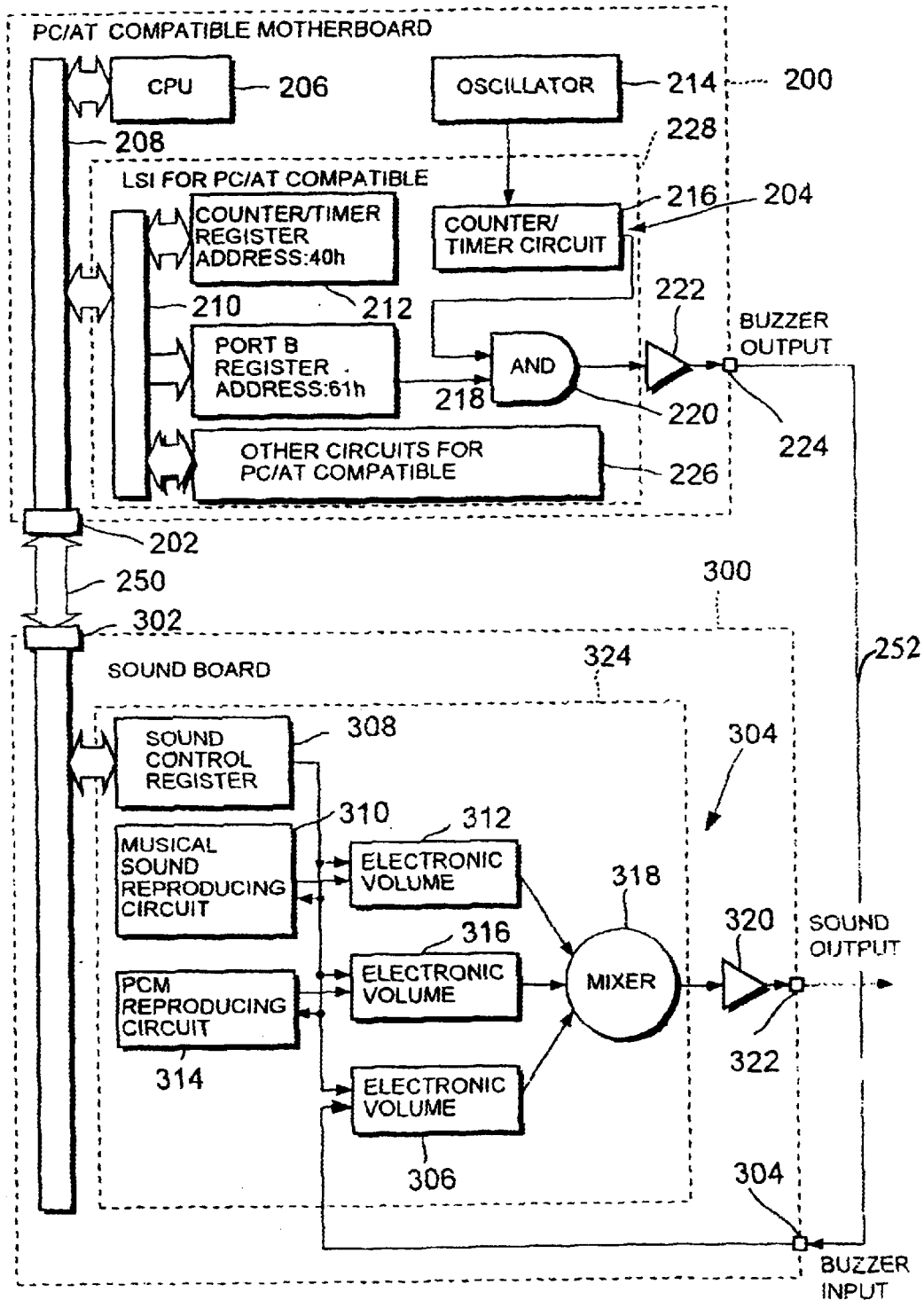
FIG. 1 is a block diagram for showing an electrical composition of a conventional buzzer signal generating device.

Referring to the drawings, preferred embodiments of the present invention will be described in detail as follows. The present invention will be described specifically by way of using examples.

Figure 3:
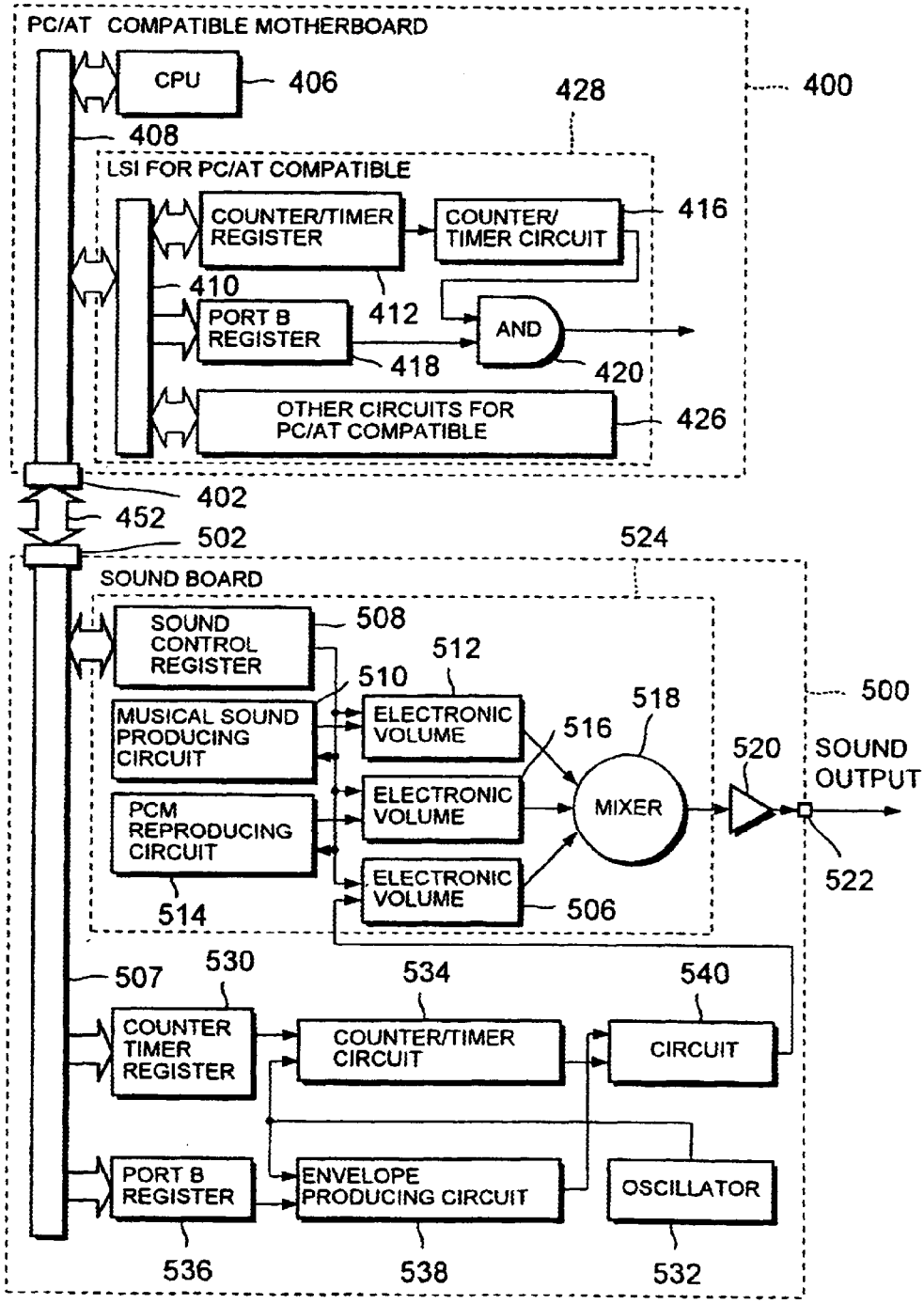
FIG. 3 is a block diagram for showing an electrical composition of the annunciatory signal generating device of the first embodiment of the present invention.
Figure 4:
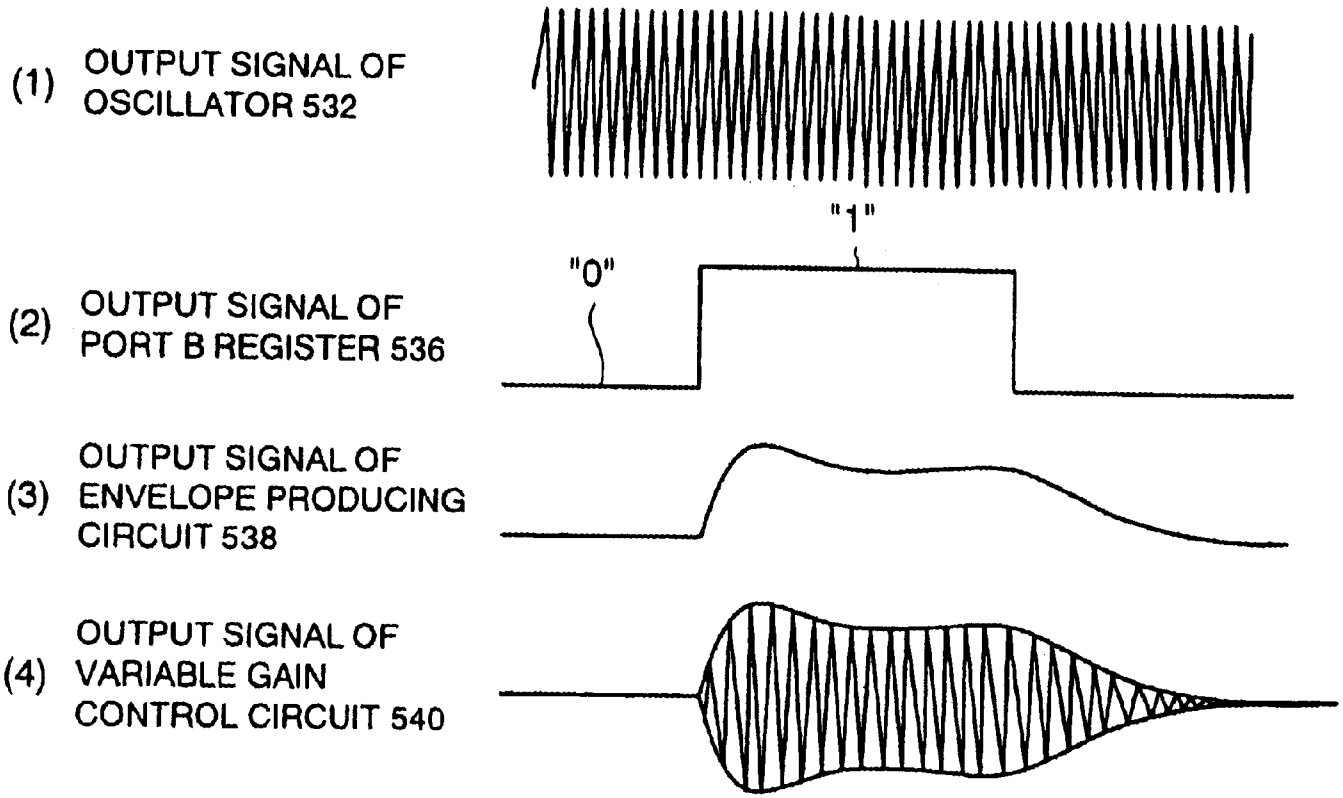
FIG. 4 is an operational waveform diagram of the above-mentioned annunciatory signal generating device.

FIG. 3 is a diagram for showing an electrical composition of an annunciatory signal generating device of an example according to the present invention and FIG. 4 is a waveform diagram of the above-mentioned annunciatory signal generating device.

An annunciatory signal generating device of this example is a device capable of eliminating a grating noise from an annunciatory sound, such as a buzzer and the like. And as shown in FIG. 3, the above-mentioned annunciatory signal generating device is composed of a CPU 406 accommodated on a motherboard (PC/AT compatible motherboard) 400 for a personal computer, a bus 408 connected to the CPU 406, a bus 410 connected to the bus 408, a counter/timer register 412, a port B register 418, an expansion slot 402 connected to the bus 408 and provided on an edge of the motherboard 400, an expansion slot 502 provided on an edge of the soundboard 500, a bus 507 connected to the expansion slot 502 and accommodated on the soundboard 500, a counter/timer register 530, an oscillator (OSC) 532, a counter/timer circuit 534, a port B register 536, an envelope producing circuit 538, a variable gain amplification circuit 540, an electronic volume 506, a mixer 518 and an amplification circuit 520.

And a connecting cable 452 connects the expansion slots 402 and 502 in the above-mentioned composition.

The counter/timer register 412 writes a data (dividing ratio data) specified by the buzzer frequency supplied from the CPU 406 through the bus 410.

The port B register 418 writes an output enabling data of a buzzer signal or an output disabling data of the buzzer signal supplied from the CPU 416 through the bus 410.

When the counter/timer register 530 is connected to the bus 507 and a dividing ratio data is written in the counter/timer register 412 addressed by the CPU 406, the counter/timer register 530 is assigned by the same address as the counter/timer register 412 and writes the above-mentioned data.

The counter/timer circuit 534 is connected to outputs of the counter/timer register 530 and the oscillator 532 and outputs a buzzer signal of rectangular wave obtained by diving oscillation frequency as much as the value determined by the dividing ratio data set by the counter/timer register 530.

When the port B register 536 is connected to the bus 507 and an output enabling data of the buzzer signal or an output disabling data of the buzzer signal is set in the port B register 418 addressed by the CPU 406, the port B register 536 is assigned by the same address as the port B register 418 and writes the above-mentioned data.

The envelope producing circuit 538 is connected to the outputs of the port B register 536 and the oscillator 532. And the envelope producing circuit 538 is composed of a transfer function for outputting an amplitude waveform which boots up gently in response to the change (for example, a change from "0" to "1") of the output enabling data of the buzzer signal written in the port B register 536 and for outputting the signal of the amplitude waveform for generating envelope which boots down gently in response to the change (for example, a change from "1" to "0") of the output disabling data of the buzzer signal written in the port B register 536.

The variable gain amplification circuit 540 is connected to the outputs of the counter/timer circuit 534 and envelope producing circuit 538 and outputs a signal output from the counter/timer circuit 534 by changing the gain as much as determined by the amplitude (voltage) of the output signal output from the envelope producing circuit 538.

A bus 410, a counter/timer register 412 and a port B register 418 for composing the annunciatory signal generating device are formed on an LSI 428 for PC/AT compatible. And an electronic volume 506 and a mixer 518 are formed on a soundboard LSI 524.

Circuits as a counter/timer circuit 416, an AND circuit 420 and other circuit 426 for PC/AT compatible having no relation to the present invention are formed on the LSI428 for PC/AT compatible. However, the above-mentioned circuits provide addresses and functions standardized in the field to which technology of this example belongs and are formed on the LSI 428 for PC/AT compatible together with the counter/timer register 412 and the port B register 418 for not more than a purpose of providing compatibility of application programs. Accordingly, the above-mentioned circuits have nothing to do with the present invention.

Figure 2:
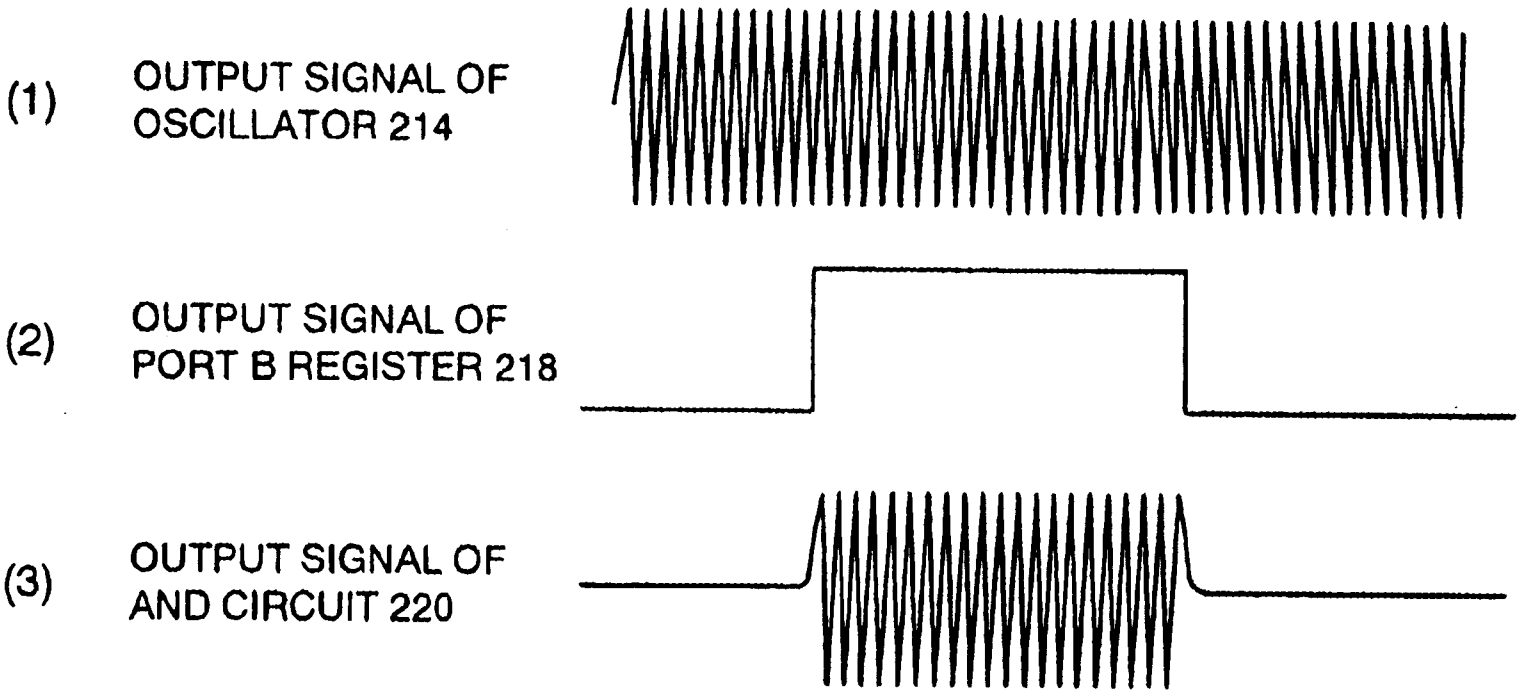
FIG. 2 is an operational waveform diagram of the above-mentioned buzzer signal generating device.

And a sound control register 508 connected to the bus 507, in which a first data for specifying the kind, scale and volume of the musical sound or a second data for specifying a PCM sound are set, a musical sound generating circuit 510 and an electronic volume 512 controlled by the first data set in the sound control register 508, a PCM reproducing circuit 514 and an electronic volume 516 controlled by the second data set in the sound control register 508 are formed on the soundboard LSI 524 shown in FIG. 2, in which outputs of the electronic volume 512 and 516 are connected to inputs of the mixer 518. Incidentally, the above-mentioned circuits have nothing to do with the present invention.

Next, referring to FIG. 3 and FIG. 4, an operation of this example is described. When an output signal of a buzzer sound needs to be output as a sound output in the annunciatory signal generating device, the CPU 406 of the motherboard 400 writes the dividing ratio data specified by the buzzer frequency in the counter/timer register 412 though the buses 408 and 410. And after that, the CPU 406 writes a buzzer output enabling data in the port B register 418 through the buses 408 and 410.

When the above-mentioned dividing ratio data is written, a counter/timer register 530 on the soundboard 500 writes the data to be written by receiving from the bus 408 through the bus 507 of the soundboard 500 in response to the above-mentioned writing of the dividing ratio data.

The dividing ratio data written in the counter/timer register 530 is supplied to the counter/timer circuit 534. The counter/timer circuit 534 supplies a signal of the frequency obtained by dividing the frequency of the oscillation signal output from the oscillator 532 as much as determined by the dividing ratio data supplied from the counter/timer register 530 to a variable gain amplification circuit 540.

When the above-mentioned buzzer enabling data is written, a port B register 536 on the soundboard 500 writes the above-mentioned buzzer enabling data by receiving from the bus 408 through the bus 507 on the soundboard 500 in response to the above-mentioned writing of the buzzer enabling data.

In response to a change (for example, a transit from a signal level of 0 to a signal level 1, as shown in (2) of FIG. 4) of the data written in the port B register 536, an envelope producing circuit 538 outputs a signal for producing envelope of waveform which boots up and boots down gently ((3) of FIG. 4).

The dividing signal divided in the counter/timer circuit 534 and the signal for producing envelope output from the envelope producing circuit 538 are supplied to the variable gain amplification circuit 540. Then, amplitude of the above-mentioned dividing signal is changed as much as the gain responsive to the voltage of the signal for producing envelope and a signal produced by superimposing the signal for producing envelope on the dividing signal is output from the variable gain amplification circuit 540.

The amplitude value of the signal output from the variable gain amplification circuit 540 is adjusted in the volume 506 and output from a sound output terminal 522 through the mixer 518 and the amplification circuit 520.

And the output signal is supplied to a buzzer not shown in drawings and a buzzer sound is emitted from the buzzer.

Further, when the output disabling signal is written in the port B register 536, the buzzer sound is stopped.

Incidentally, when a data for specifying a desirable kind, scale and volume of a musical sound is set in the sound control register 508 by order from the CPU 406 through the buses 408 and 507, a signal of the musical sound responsive to the above-mentioned data is output as a signal of a musical sound from the sound output terminal 522 through the musical sound producing circuit 510, an electronic volume 512, a mixer 518 and the amplification circuit 520. And when a data for specifying a desirable PCM waveform to be reproduced is set in the sound control register 508 by order from the CPU 406 through the buses 408 and 507, a signal of the PCM waveform responsive to the above-mentioned data is output as a signal of a desirable PCM waveform to be reproduced from the sound output terminal 522 through a PCM reproducing circuit 514, an electronic volume 516, a mixer 518 and the amplification circuit 520.

Thus, this example is directed towards producing the variable gain control signal which changes the amplitude of the dividing signal according to a gentle slope. Accordingly, an occurrence of the grating noise produced by interruption of the dividing signal can be avoided. Therefore, in the event of implementing the present device of this example in, for example, a POS terminal equipment, and the like, it is possible to prevent not only the operators but also customers from getting an uncomfortable feeling.

Further, according to the composition of the device in which the motherboard is connected to the soundboard, an operation for connecting the buzzer output terminal of the motherboard to the buzzer input terminal of the soundboard is not required.

A Second Example

Figure 5:
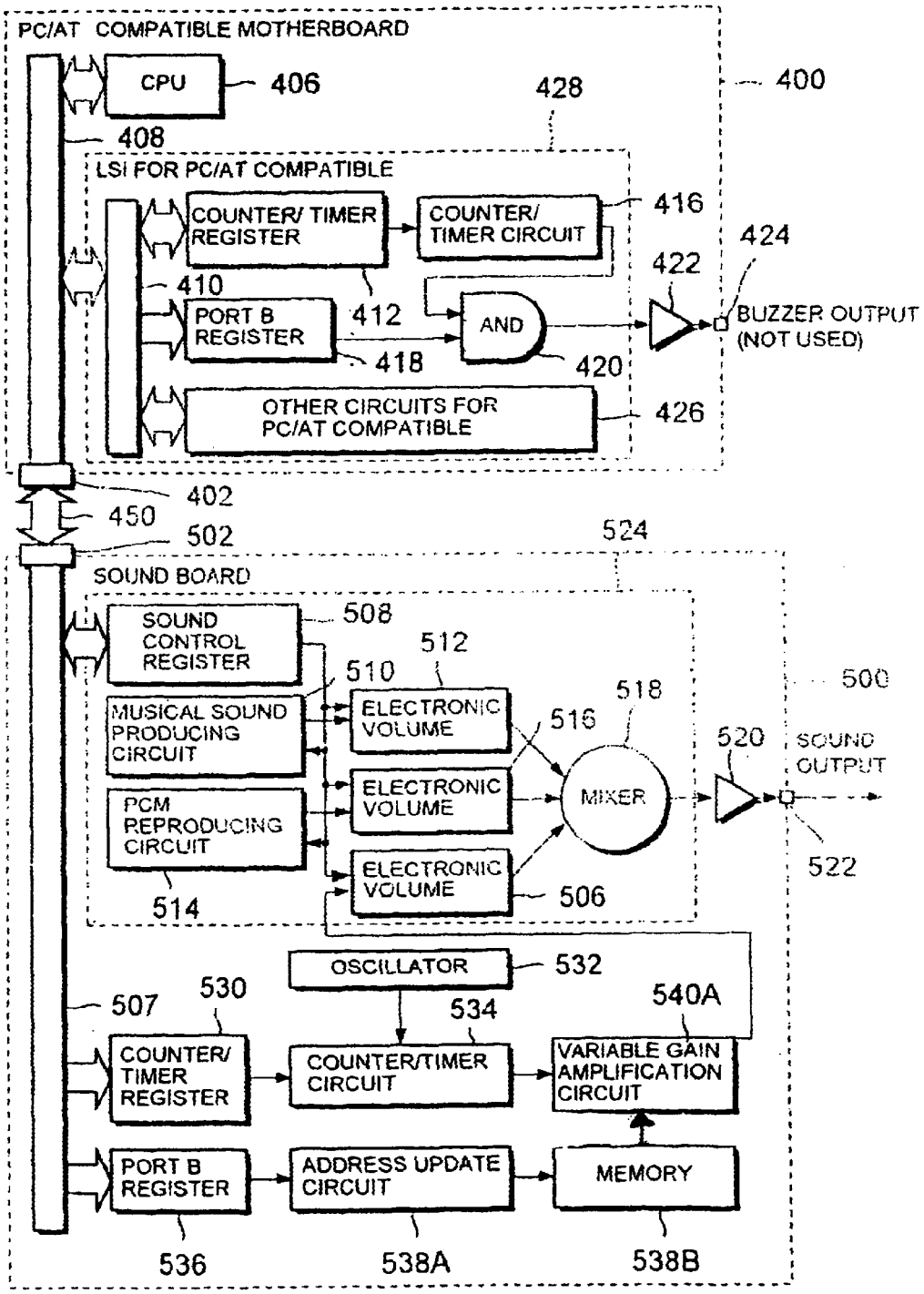
FIG. 5 is a block diagram for showing an electrical composition of the annunciatory signal generating device of the second embodiment of the present invention.

FIG. 5 is a block diagram for showing an electric composition of the annunciatory signal generating device of a second example according to the present invention.

The composition of this example differs from the composition of the first example mostly in storing a data corresponding to the signal for producing envelope produced in the envelope producing circuit in the memory in advance and outputting a data for producing envelope.

That is, this example is composed of the envelope producing circuit 538 of the first example providing an address updating circuit 538A and a memory 538B. Incidentally, the address updating circuit 538A outputs a starting address in response to the output enabling data to be written in the port B register 536, updates the above-mentioned starting address, outputs the new address at each updating and stops the updating of the address in response to the output disabling data to be written in the port B register 536. And the memory 538B stores the a data (a variable gain control data) for producing envelope in a storing position specified by the address output from the address updating circuit 538A. An envelope represented by the data for producing envelope from the starting address to the ending address is equal to the envelope represented by the signal for producing envelope output from the envelope producing circuit 538 of the first example.

And the variable gain amplification circuit 540A is composed in which the gain is changed by the data for producing envelope output from the memory 538B.

Incidentally, the composition of this example is same as the composition of the first example except for the above-mentioned points. Accordingly, in FIG. 3, the same portion has the same number as the component in FIG. 1 and repetitive descriptions are abbreviated.

For the next, referring to FIG. 5, an operation of a second example is described.

The following aspects in the operation in the second example is same as the operation of the first example. That is, an aspect that when the dividing ratio data is written in the counter/timer register 412 by order from the CPU 406, the dividing ratio data is written in the counter/timer register 530 and is supplied to the variable gain amplification circuit 540A by dividing a frequency of the oscillation signal output from the oscillator 532 as much as the data specified by the dividing ratio. And another aspect that when the output enabling data or output disabling data is written in the port B register 418 by order from the CPU 406, the output enabling data or output disabling data is written in the port B register 536.

In this example, in response to the writing of the output enabling data in the port B register 536, the address updating circuit 538A outputs a starting address and updates the address in sequence to output the updated address.

The above-mentioned address updated in sequence is supplied to the memory 538B. The data for producing envelope is read from the storing position specified by the above-mentioned address of the memory 538B by each address and supplied from the memory 538B to the variable amplification circuit 540A.

The dividing signal supplied from the counter/timer circuit 534 to the variable gain amplification circuit 540A is output from the variable gain amplification circuit 540A by receiving the gain the value determined by the above-mentioned data for producing envelope supplied in sequence to the variable gain amplification circuit 540A.

After that, the signal output from the variable gain amplification circuit 540A is supplied as an annunciatory signal from the sound output terminal 522 to the buzzer not shown in diagrams through the electric volume 506, the mixer 518 and the amplification circuit 520 and a buzzer sound is emitted in the same manner as the first example.

Finally, when the output disabling data is written in the port B register 536, the buzzer sound is stopped.

Thus, this example is composed in order to change the amplitude of the divided oscillation signal by the data for producing envelope. Accordingly, an occurrence of the grating noise produced by interruption of the divided oscillation signal can be avoided. Therefore, in the event of implementing the present device of this example in, for example, a POS terminal equipment, and the like, it is possible to prevent not only the operators but also customers from getting uncomfortable feeling.

Further, according to the composition of the device in which the motherboard is connected to the soundboard, an operation for connecting the buzzer output terminal of the motherboard to the buzzer input terminal of the soundboard is not required.

A Third Example

Figure 6:
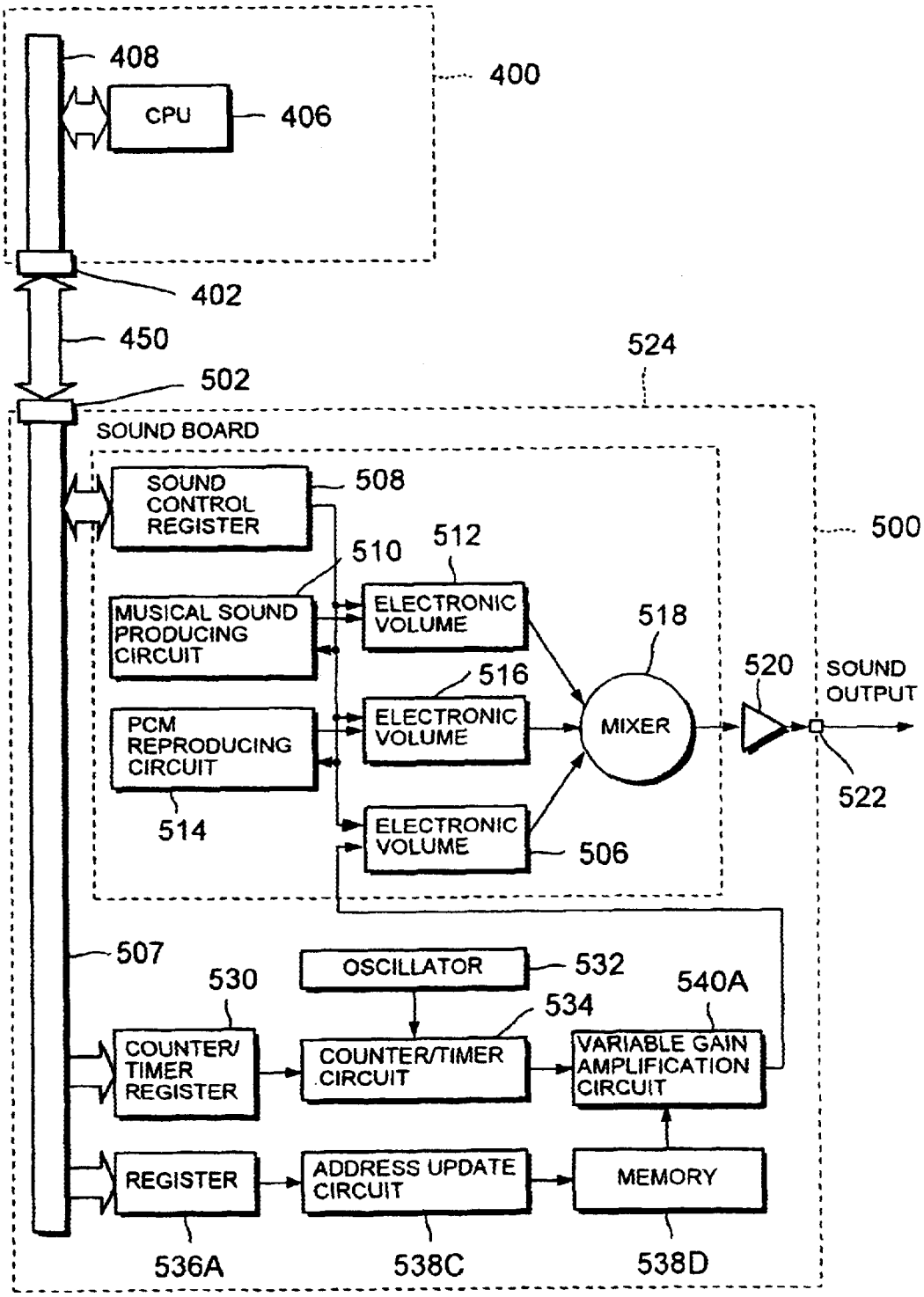
FIG. 6 is a block diagram for showing an electrical composition of the annunciatory signal generating device of the third embodiment of the present invention.

FIG. 6 is a block diagram for showing an electric composition of the annunciatory signal generating device of a third example according to the present invention.

The composition of this example differs from the composition of the first example mostly in enabling an output of the annunciatory signal of each scale of sound. That is, an identification data for indicating types of the annunciatory signal is provided settable in the register 536A, a start-reading address and a stop-reading address is generated from the set identification data, the start-reading address is output and updated to a new address, an address updating circuit 538 C is composed to stop updating the address when the updated address is reached to the generated stop-reading address, and a variable gain control data capable of providing a similar effect as the signal for producing envelope of the first example is stored in a memory 538D in response to the address from the generated start-reading address to the stop-reading address.

And the whole of the annunciatory signal generating device is composed of the bus 408 of the motherboard 400 and the bus 507 of the soundboard 500 connected to each other by the cable 450.

Incidentally, the composition of this example is same as the composition of the first example except for the above-mentioned point. Accordingly, in FIG. 6, the same portion has the same number as the component in FIG. 3 and repetitive descriptions are abbreviated.

Next, referring to FIG. 6, an operation of the third example is described.

In the third example, the dividing ratio data is written in the counter/timer register 530 by the CPU 406 and an identification data is written in the register 536A by the CPU 406.

When the identification data is written in the register 536A, the address updating circuit 538C decodes the start-reading address and the stop-reading address and outputs the start-reading address which is updated in sequence to be output.

The address updated in sequence is supplied to the memory 538D. And the data for producing envelope is read from the storing position specified by the above-mentioned address by each address and supplied from the memory 538D to the variable gain amplification circuit 540A.

The dividing signal supplied from the counter/timer circuit 534 to the variable gain amplification circuit 540A is output from the variable gain amplification circuit 540A by receiving the gain the value determined by the above-mentioned data for producing envelope supplied in sequence to the variable gain amplification circuit 540A.

After that, the signal output sequentially from the variable gain amplification circuit 540A is supplied as an annunciatory signal from the sound output terminal 522 to the buzzer not shown in the diagrams through the electric volume control 506, the mixer 518 and the amplification circuit 520 and a buzzer sound emitted in the same manner as the first example.

Thus, according to this example, an envelope is determined in response to the set identification data and to the change in the amplitude of the divided oscillation signal divided by the produced data for producing envelope. Accordingly, it is possible to avoid an occurrence of a grating noise produced by an interruption of the buzzer sound signal in a different scale of the buzzer sound. Therefore, in the event of implementing the present device of this example in, for example, a POS terminal equipment, and the like, it is possible not only to provide various kinds of buzzer sounds (alarm sounds) to the operator but also to prevent the operators and customers from getting an uncomfortable feeling.

Further, according to the composition of the device in which the motherboard is connected to the soundboard, an operation for connecting the buzzer output terminal of the motherboard to the buzzer input terminal of the soundboard is not required.

The examples of the present invention have been described in detail as above with reference to the drawings. However, the particular compositions of the present invention are not limited to the specific examples and variations or modifications in design, and the like within the scope of the invention are included in the present invention.

For example, other signals which can be used for generating an annunciatory signal instead of the divided signal are acceptable and can be supplied to the variable gain amplification circuits 540 and 540A for changing the amplitude as mentioned above.

The second example and the third example are composed to be able to provide means for setting the scale and stress of the sound variably. Accordingly, for example, the speed of reading by the memory 538B can be changed in the second example and the third example. It is also possible to compose the device in which the change can be performed by the updated speed of the address updating circuits 538A and 538C fixedly or variably using hardware or by a data of updated speed from the CPU 406 variably.

Further, in the composition, it is acceptable that a data read from the memory 538B or the memory 538D is converted to an analog signal and supplies to the variable gain amplification circuit 540A.

As described above, according to the composition of the present invention, amplitude of a divided oscillation signal is changeable by a signal or a data for producing envelope. Accordingly, it is possible to prevent a grating noise generated by the interruption of the annunciatory signal at a certain scale of sound from superimposing on the annunciatory sound at the scale.

Additionally, as the data for producing envelope is changeable in composition, it is possible to emit annunciatory sound of various scales without being superimposed by a grating noise with no requirement of changing hardware therein.

And in the event of implementing the device of this example, for example, in a POS terminal equipment, and the like, it is possible to prevent customers from getting uncomfortable feeling caused by the annunciatory sound emitted toward operators.

Further, according to the composition of the device in which the motherboard is connected to the soundboard, an operation for connecting the buzzer output terminal of the motherboard to the buzzer input terminal of the soundboard is not required.

What is claimed is:

1. An annunciatory signal generating method, comprising the steps of:

generating an annunciatory signal based on a generating signal used for generating the annunciatory signal, a first signal for indicating a start of the annunciatory signal and a second signal for indicating a stop of said annunciatory signal; and generating a variable gain control signal which boots up gently and makes a transition at a predetermined level of fluctuation based on said first signal and boots down gently based on said second signal, wherein said annunciatory signal is generated by controlling the amplitude of said generating signal according said variable gain control signal.

2. An annunciatory signal generating method claimed in claim 1, wherein said second signal is generated from said first signal.

3. An annunciatory signal generating method claimed in claim 1, wherein said first signal is "1" of the binary signal and said second signal is "0" of the binary signal.

4. An annunciatory signal generating method claimed in claim 1, wherein said first and said second signals are obtained by decoding a data for indicating the types of the annunciatory signal.

5. An annunciatory signal generating device, comprising:

first means for outputting a generating signal used for generating an annunciatory signal;

second means for outputting a first signal for indicating a start of the annunciatory signal and a second signal for indicating a stop of the annunciatory signal;

means for generating the annunciatory signal based on the generating signal output from said first means and also based on said first signal and said second signal output from said second means;

means for generating a variable gain control signal which is connected to said second means, said means for generating a variable gain control signal boots up gently and makes a transition at a predetermined level of fluctuation based on said first signal output from said second means and boots down gently based on said second signal output from said second means; and means for controlling variable gain which is connected to said first means and to said means for generating variable gain control signal, said means for controlling variable gain outputs said annunciatory signal by controlling the amplitude of the signal used for generating said annunciatory signal output from said first means by said variable gain control signal generated from said means for generating variable gain control signal.

6. An annunciatory signal generating device claimed in claim 5, wherein said second means generates said second signal from said first signal.

7. An annunciatory signal generating device claimed in claim 5, wherein said first means comprises:

an oscillator, means for outputting a dividing ratio signal, and a dividing circuit for dividing a frequency of an oscillation signal output from said oscillator as much as the dividing ratio of the dividing ratio signal output from said means for outputting dividing ratio signal.

8. An annunciatory signal generating device claimed in claim 5, wherein said second means outputs said first signal as "1" and said second signal as "0" of the binary signal respectively and said means for generating variable gain control signal is composed of the transfer function capable of outputting a signal portion which is responsive to "1" of said binary signal, boots up gently and makes a transition at a predetermined level of fluctuation in said variable gain control signal and at the same time, capable of outputting a signal portion which is responsive to "0" of said binary signal and boots down gently in said variable gain control signal.

9. An annunciatory signal generating device claimed in claim 8, wherein said means for generating variable gain control signal is composed to operate at predetermined intervals after operating on receiving a signal from said second means.

10. An annunciatory signal generating device claimed in claim 8, wherein said second means is a central processing unit accommodated in a motherboard and said means for generating variable gain control signal is accommodated in a soundboard connected to said motherboard.

11. An annunciatory signal generating device claimed in claim 10, wherein said means for generating variable gain control signal accommodated in said soundboard has a composition capable of maintaining the compatibility of application programs in the central processing unit accommodated in said motherboard.

12. An annunciatory signal generating device claimed in claim 5, wherein said second means outputs said first signal as "1" and said second signal as "0" of the binary signal respectively and said means for generating variable gain control signal comprises:

decoding means for outputting a start-reading address in response to "1" of said binary signal and a stop-reading address in response to "0" of the binary signal, means for outputting addresses for outputting said start-reading address, updating an address from said start-reading address and determining whether the updated address reached to said stop-reading address or not, and memories for storing variable gain control data capable of providing the similar effects as said variable gain control signal, reads said memories by addresses from start-reading address to stop-reading address output from means for outputting address and supplies a variable gain control data to said means for controlling variable gain by each address.

13. An annunciatory signal generating device claimed in claim 5, wherein said second means outputs said first signal and said second signal by a signal for indicating the types of said annunciatory signal and said means for generating variable gain control signal comprises:

decoding means for decoding the signal indicating the type of the above-mentioned annunciatory signal and outputting the start-reading address and the stop-reading address, means for outputting addresses for outputting said start-reading address, updating an address from said start-reading address and determining whether the updated address reached to said stop-reading address or not, and memories for storing variable gain control data capable of providing the similar effects as said variable gain control signal, reads said memories by addresses from start-reading address to stop-reading address output from means for outputting address and supplies a variable gain control data to said means for controlling variable gain by each address.

* * * * *